US008371374B2

(12) United States Patent
Foster et al.

(10) Patent No.: US 8,371,374 B2
(45) Date of Patent: Feb. 12, 2013

(54) SEALING FEED THROUGH LINES FOR DOWNHOLE SWELLING PACKERS

(75) Inventors: Anthony P. Foster, Katy, TX (US); Robert O. Castillo, Stafford, TX (US); Ammar Munshi, Houston, TX (US); Edward T. Wood, Kingwood, TX (US); Gregory C. Badke, Houston, TX (US); Nervy Enrique Faria, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/461,126

(22) Filed: May 1, 2012

(65) Prior Publication Data

US 2012/0227958 A1 Sep. 13, 2012

Related U.S. Application Data

(62) Division of application No. 13/180,062, filed on Jul. 11, 2011, now Pat. No. 8,225,861, which is a division of application No. 12/401,994, filed on Mar. 11, 2009, now Pat. No. 7,997,338.

(51) Int. Cl.
*E21B 33/12* (2006.01)

(52) U.S. Cl. ..... 166/188; 166/195; 166/242.2; 166/242.3

(58) Field of Classification Search ..... 166/387, 166/385, 242.2, 242.3, 188, 195
See application file for complete search history.

(56) References Cited

U.S. PATENT DOCUMENTS

| | | | |
|---|---|---|---|
| 56,234 | A | 7/1866 | Latham |
| 2,945,541 | A | 7/1960 | Maly et al. |
| 3,899,631 | A | 8/1975 | Clark |
| 6,173,788 | B1 | 1/2001 | Lembcke et al. |
| 7,387,158 | B2 | 6/2008 | Murray et al. |
| 7,392,841 | B2 | 7/2008 | Murray et al. |
| 7,431,082 | B2 | 10/2008 | Holt et al. |
| 7,441,596 | B2 | 10/2008 | Wood et al. |
| 7,478,678 | B2 | 1/2009 | Farrar et al. |
| 7,552,768 | B2 | 6/2009 | O'Brien |
| 7,611,339 | B2 | 11/2009 | Tetzlaff et al. |
| 7,730,940 | B2 | 6/2010 | Knippa et al. |
| 7,762,322 | B2 | 7/2010 | Andersen et al. |
| 7,784,797 | B2 | 8/2010 | Baugh et al. |

(Continued)

FOREIGN PATENT DOCUMENTS

| | | |
|---|---|---|
| WO | 2004057715 | 7/2004 |
| WO | 2005090743 | 9/2005 |

OTHER PUBLICATIONS

Reliable Zonal Isolation, Halliburton Brochure, date unknown, 2 pages.

(Continued)

*Primary Examiner* — Jennifer H Gay
(74) *Attorney, Agent, or Firm* — Steve Rosenblatt

(57) ABSTRACT

A swelling element on a packer has a trough formed on a longitudinal axis. The control line or cable or conduit that needs to run along the string where the packer is mounted is first wrapped in a preferably non-swelling underlayment that can be a loose scroll or have its seam sealed. A swelling cover is placed over the underlayment using a seam that can be longitudinal or spiral to allow rapid deployment. The covering assembly for the control line or conduit is placed in the slot of the swelling element of the packer. The line or cable continues out opposed ends and can be secured to the tubular string with clamps. The control line can be covered with a swelling material and forced into a groove that runs the length of the packer swelling element.

4 Claims, 3 Drawing Sheets

U.S. PATENT DOCUMENTS

| | | | |
|---|---|---|---|
| 7,836,960 | B2 | 11/2010 | Patel et al. |
| 7,896,070 | B2 | 3/2011 | Lovell |
| 2007/0012436 | A1 | 1/2007 | Freyer |
| 2007/0046115 | A1 | 3/2007 | Tetzlaff et al. |
| 2007/0114016 | A1 | 5/2007 | Brezinski et al. |
| 2007/0114017 | A1 | 5/2007 | Brezinski et al. |
| 2007/0114018 | A1 | 5/2007 | Brezinski et al. |
| 2007/0114019 | A1 | 5/2007 | Brezinski et al. |
| 2007/0114044 | A1 | 5/2007 | Brezinski et al. |
| 2007/0158060 | A1 | 7/2007 | Baaijens et al. |
| 2007/0267201 | A1 | 11/2007 | Brezinski et al. |
| 2008/0251250 | A1 | 10/2008 | Brezinski et al. |
| 2009/0173505 | A1 | 7/2009 | Patel et al. |
| 2009/0250228 | A1 | 10/2009 | Loretz et al. |
| 2009/0277652 | A1 | 11/2009 | Nutley et al. |
| 2009/0283254 | A1 | 11/2009 | Andersen et al. |
| 2010/0019456 | A1 | 1/2010 | Gerrard |
| 2010/0065284 | A1 | 3/2010 | Freyer |
| 2010/0230094 | A1 | 9/2010 | Foster et al. |
| 2010/0294484 | A1 | 11/2010 | Castillo et al. |
| 2011/0056706 | A1 | 3/2011 | Brooks |

OTHER PUBLICATIONS

Intelligent Systems and Components Swellpacker, Cable system has self-healing properties, Halliburton, Hart Energy Publishing, date unknown, 1 page.

Yakeley, S., et al., "Swellable Packers for Well Functioning and Stimulation", SPE110621, Nov. 2007, 1-7.

Yakeley, Sean, et al., "Contcting the Reservoir—Benefits of Horizontal Open-Hole Completions", SPE 12074, Sep. 2009, 1-4.

Moreira, O.M., et al, "Integrating Intelligent-Well Systems into Sandface Completions for Reservoir Control in Brazilian Subsea Well", SPE 97215, Oct. 2005, 1-4.

Coronado, Martin P., et al., "Advanced Openhole Completions Utilizing a Simplified Zone Isolation System", SPE 77438, Sep. 2002, 1-11.

Halliburton Swellpacker Cable System Data Sheet, 2008, 2 pages.

Antonio, Luiz, et al., "Swelling Packer Technology Eliminates Problems in Difficult Zonal Isolation in Tight-Gas Reservoir Completion", SPE 107578, Apr. 2007, 1-4.

Hembling, Drew, et al., "Swell Packers: Enabling Openhole Intelligent and Multilateral Well Completions for Enhanced Oil Recovery", IADC/SPE 100824, Nov. 2006, 1-8.

Kennedy, G., et al., "The Use of Swell Packers as a Replacement and Alternative to Cementing", SPE 95713, Oct. 2005, 1-4.

SEALING FEED THROUGH LINES FOR DOWNHOLE SWELLING PACKERS

PRIORITY INFORMATION

This application is a divisional of U.S. patent application Ser. No. 13/180,062 filed on Jul. 11, 2011, which is a divisional of U.S. patent application Ser. No. 12/401,994 filed on Mar. 11, 2009, now U.S. Pat. No. 7,997,338.

FIELD OF THE INVENTION

The field of the invention is swelling packers that are used in downhole applications where there are conduits or lines that follow the tubing string where the packer is mounted and need to run past the packer without joints so that the packer seals on swelling.

BACKGROUND OF THE INVENTION

A variety of styles of packer have been used downhole for isolation. In some applications there is a need to run various conduits or lines past a packer. In the past the packer mandrels have been provided with a passage and end connections at opposed ends which required connections to be made at the surface before running the packer into the wellbore. The problem of connections was more severe in some applications than others. For example if the line was a hydraulic control line, then the connections posed a potential for leakage. If the line was a fiber optic then ensuring a clean connection at a splice was a significant issue.

One attempt to deal with control lines in a packer environment involving pipe expansion is illustrated in FIGS. 2, 40 and 42 of the following related US applications: 20080251250; 20070267201; 20070114044; 20070114019; 20070114018; 20070114017 and 20070114016. In these references rubber rings are secured outside a tubular. The rings have bores through which the control lines extend. The assembly is expanded from within the tubular to seal within a wellbore and to protect the control lines from damage. Swelling is not used in these references while some embodiments also include inflatable concepts.

Swelling packers respond to well fluids or introduced fluids to grow larger and seal in a wellbore. Covers or other time delay techniques have been used to allow time to run in the packer to the desired depth before it swells into a sealing relationship with a surrounding tubular or the open hole. In these applications a longitudinal channel for control lines in the swelling element have been provided that extends between opposed ends with the idea being that such a trough will close up when swelling occurs. This feature is in a Swellpacker® Cable System sold by Halliburton. The sealing reliability of such a design, however, depended on a fairly symmetrical borehole and a swelling closed of an open trough over the control line for the length of the sealing element, which did not always occur.

The present invention addresses the shortcomings in the Halliburton packer in an effort to enhance the integrity of the seal once swelling has occurred. In one embodiment a swelling element has a milled slot with a longitudinal cut extending through the slot that goes between opposed ends of the element. The control line or conduit is first wrapped in an underlayment that is rubber that does not swell. The ends can overlap each other in a scroll fashion or can be otherwise joined together. An outer tube that can be longitudinally or spirally split is put over the control line underlayment. The underlayment and its outer cover fit into the elongated slot in the swelling element. If the slot in the outer tube for the control line or conduit has a longitudinal split, the split is rotated to not show in the elongated slot of packer sealing element. Other embodiments are envisioned and described below. Those skilled in the art will better understand some of the embodiments of the invention from the description below and the associated figures while appreciating that the full scope of the invention is to be found in the appended claims.

SUMMARY OF THE INVENTION

A swelling element on a packer has a trough formed on a longitudinal axis. The control line or cable or conduit that needs to run along the string where the packer is mounted is first wrapped in a preferably non-swelling underlayment that can be a loose scroll or have its seam sealed. A swelling cover is placed over the underlayment using a seam that can be longitudinal or spiral to allow rapid deployment. The covering assembly for the control line or conduit is placed in the slot of the swelling element of the packer. The line or cable continues out opposed ends and can be secured to the tubular string with clamps with the option of leaving some slack on one or both ends. In an alternative embodiment the control line is covered with a swelling material and forced into a groove that runs the length of the packer swelling element.

DETAILED DESCRIPTION OF THE PREFERRED EMBODIMENT

Figure 1:
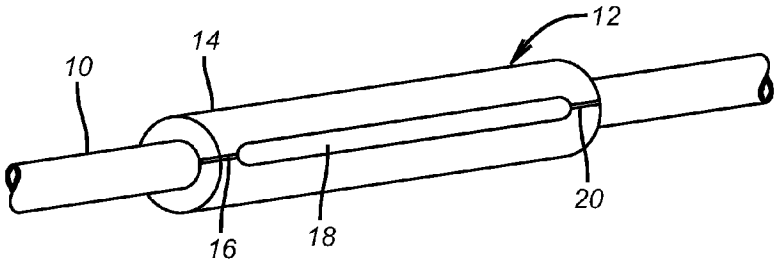
FIG. 1 illustrates a swelling packer element showing a slot for the covered control line or conduit.

Referring to FIG. 1 a portion of a tubular string 10 is shown with a swelling packer sealing element 12. The material for element 12 can vary. It can have a cover that delays the onset of swelling. The triggering fluid or stimulus for swelling can vary. There is a groove from the outer surface 14 that preferably extends longitudinally and has three segments 16, 18 and 20.

Figure 7:
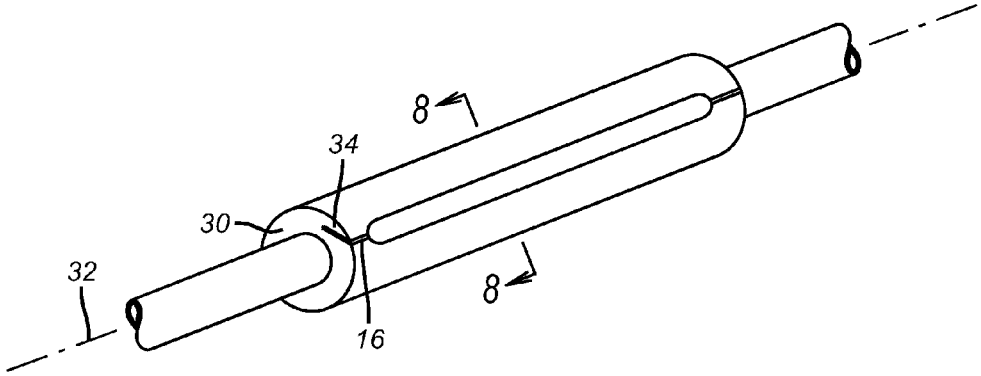
FIG. 7 shows a slanted end cut into the swelling element where the cable or line exits to create a flap to enhance end sealing when the sealing element swells.

Segment 18 is broader and deeper than the segments 16 and 20 that are disposed on opposed sides of it. Segment 18 has to accommodate the cover assembly 22 shown in FIGS. 2 and 5. The control line or cable or fiber optic or any elongated structure 24 that has to traverse the element 12, hereinafter referred to collectively as a "conduit" goes through the assembly 22 as shown in FIG. 3. Clamps 26 and 28 can be used to secure the conduit 24 on opposed sides of the element 12 with some slack left in the conduit 24 between the clamps 26 and 28 to allow for thermal differential expansion. Note that in FIG. 3 the groove 16 terminates at end face 30 of the element 12 and its center is in line through axis 32. Compare that to an alternative embodiment in FIG. 7 where the same end face 30 is shown and groove 16 is askew and not along a radial line from the axis 32. In both embodiments the opposite end face is preferred to be identical to the detail shown in the end face 30. Note that in the FIG. 7 embodiment the orientation of the groove 16 in the face 30 creates a flap 34 that is compressed closed when the swelling of the element 12 takes place. This effect helps to keep the end faces 30 sealed by using parts of element 12 to double over on groove 16 and at groove 18 on the opposite end (not shown) to tightly close them off even more so than the orientation shown in FIG. 3 where the groove such as 16 extends radially when cut in end face 30. The same effect can be accomplished in the cover assembly 22 shown in FIG. 2. While a single assembly of grooves 16,18 and 20 is illustrated, those skilled in the art will appreciate that multiple circumferentially spaced groove assemblies can be used in a single element 12 to handle discrete conduits 24 at the same time.

Figure 6:
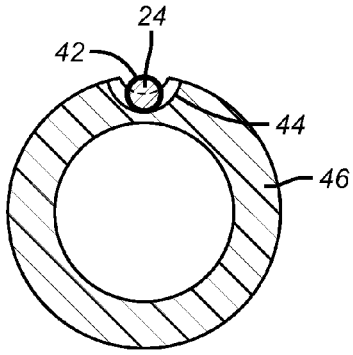
FIG. 6 is an alternative design using a groove in the sealing element and forcing a covered control line or cable into the groove.

To make the cover assembly 22 a mandrel 36 is employed. An inner layer 38 preferably made of a non-swelling rubber or other not swelling material is extruded onto mandrel 36 as a preferably seamless tube that is in tension against the mandrel 36 and may be optionally adhered to mandrel 36. Thereafter, an outer layer 40 made preferably of a swelling rubber or other swelling material is extruded or otherwise applied to the inner layer and preferably bonded to it with adhesive or alternatively applied with an interference fit as to hold the two layers together. The two layers 38 and 40 may simply be in contact particularly if the outer layer 40 is water swellable. The inner layer 38 retains the inside surface of the outer layer 40 from a tendency to grow when swelling. By overcoming this tendency a potential leak path between the conduit 24 and the outer layer 40 can be avoided. However, the inner layer is optional as shown in FIG. 6 and a swelling material 42 can be singularly applied to the conduit 24 in a tube form or as a spiral wrap and simply forced in an interference fit into a groove 44 in a packer sealing element 46 as an alternative embodiment. In another variation layers 38 and 40 may be cured together so that the interface between them cross-links so that no adhesive between the layers is needed.

Figure 2:
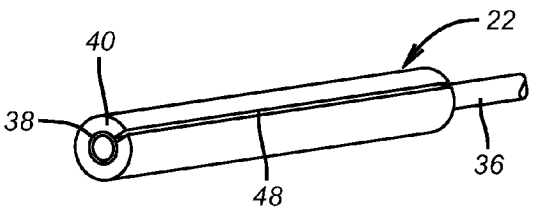
FIG. 2 shows the two layer cover assembly for a control line or conduit.
Figure 3:
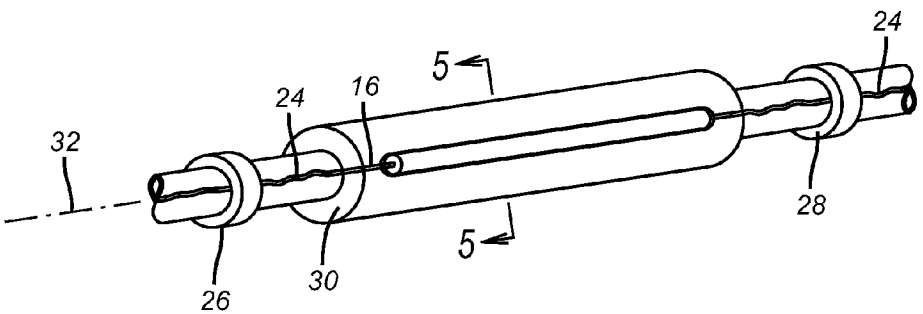
FIG. 3 shows the covered control line assembled to the packer sealing element.
Figure 4:
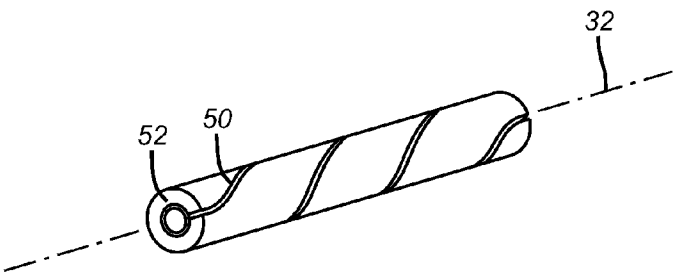
FIG. 4 is an alternative embodiment to the design in FIG. 2 showing a spiral cut.
Figure 5:
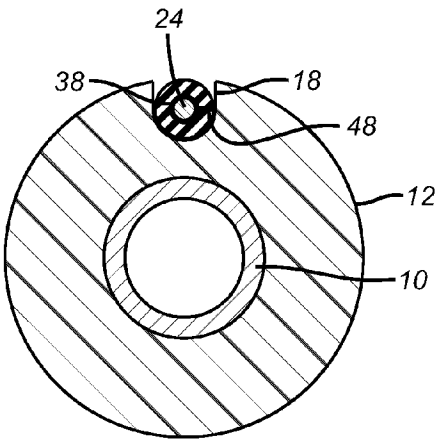
FIG. 5 is a section view along lines 5-5 of FIG. 3.

Looking again at FIG. 2 the finished assembly 22 while on the mandrel can be cut longitudinally as shown at 48 in FIG. 2 or spirally as shown at 50 in FIG. 4. The cut at opposes end faces, such as 52 in FIG. 4 can be a radial line from centerline 32 or an offset cut that avoids the centerline 32 and creates a flap so that when swelling of the element 12 and the assembly 22 assembled into the groove 18 in element 12 occurs the ends of assembly 22 will be pushed against each other. In the case where a longitudinal cut 48 is made to facilitate installation of the assembly 22 on the conduit 24 the orientation of the cut 48 should be within groove 18 as shown in FIG. 5. If there is a spiral cut 50 its ends near the end faces 52 (only one of which is shown) should also be within groove 18 to keep the ends of the assembly 22 pushed to a sealing position when assembly 22 swells with the sealing element 12.

Figure 8:
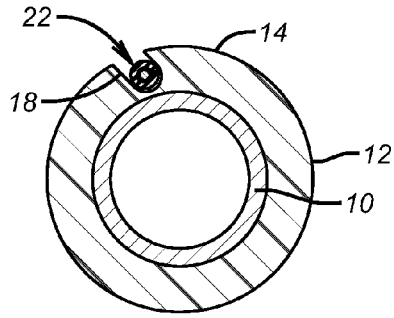
FIG. 8 is a section along line 8-8 of FIG. 7.
Figure 9:
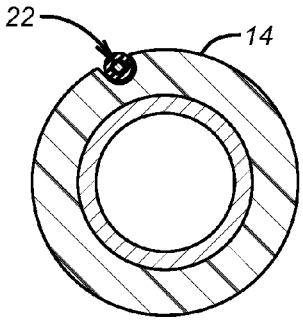
FIG. 9 is an alternative embodiment to FIG. 8 showing a different amount of embedding in the groove of the swelling element.

Ideally, when the element 12 swells the outer surface of assembly 22 is at the outer surface 54 of element 12 as shown in FIG. 9 or within the outer surface 14 of sealing element 12 as shown in FIG. 8 in groove 18. Ideally, the swelling of assembly 22 should fill the swelled dimensions of groove 18 and not extend beyond the outer surface 14 of seal 12 so that as much of the outer surface 14 as possible can contact the surrounding tubular or formation (not shown).

Figure 10:
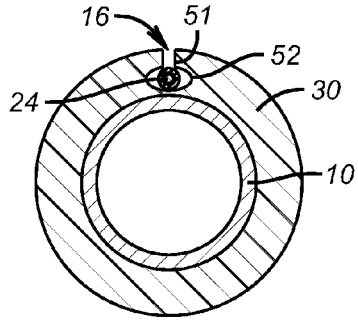
FIG. 10 is an end view of a swelling sealing element showing the keyhole shaped groove.
Figure 11:
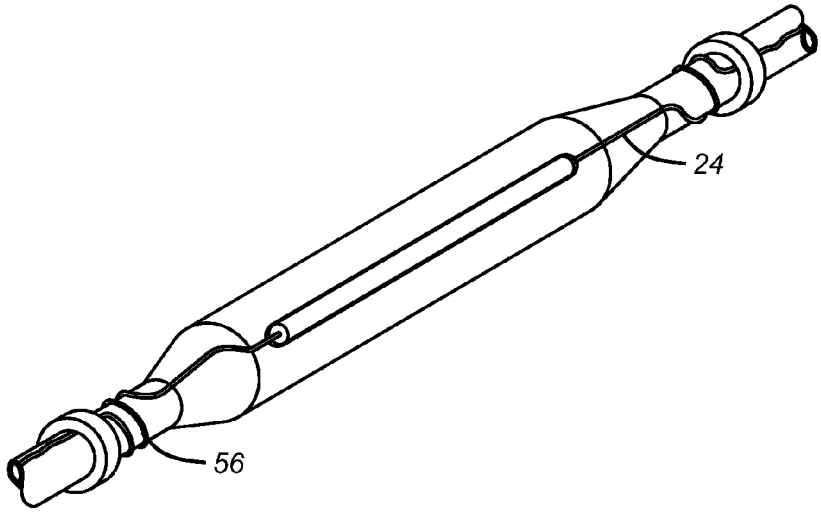
FIG. 11 is a perspective view showing the slack in the conduit around the mandrel.
Figure 12:
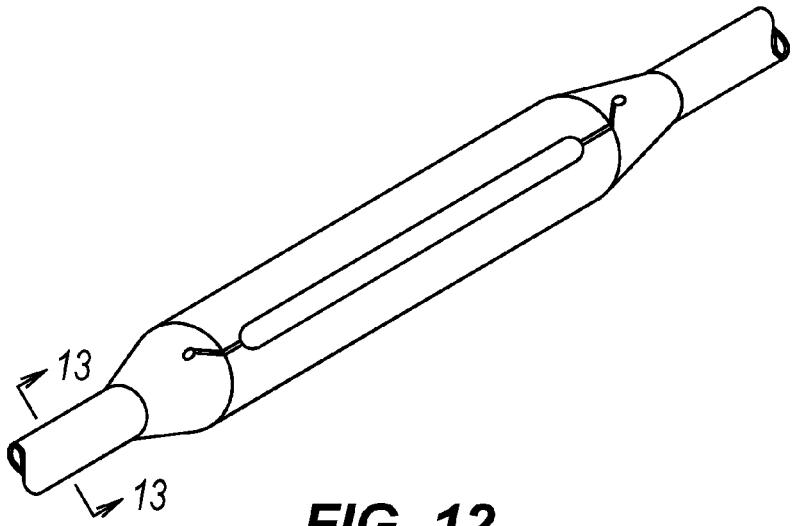
FIG. 12 shows a skewed keyhole shape for the groove that is not aligned with the axis of the mandrel.
Figure 13:
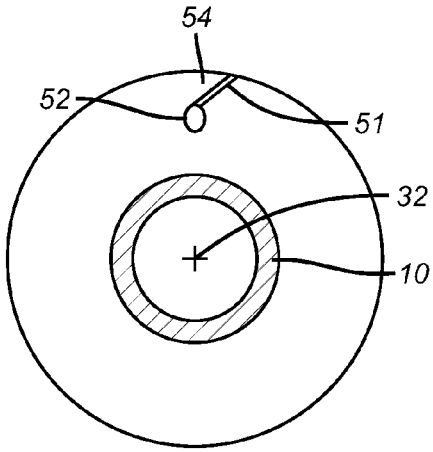
FIG. 13 is the view along lines 13-13 of FIG. 12.

It should be noted that the end grooves 16 and 20 in the element 12 terminate at the end faces 30. The conduit 24 can simply be brought up the end face 30 or simply depart from the tubular 10 and placed into end groove 16 or 20 with those end grooves preferably sized for the conduit or conduits 24 that will pass through them with perhaps a little room left over, particularly if the end grooves are slant oriented so that their centerline does not intersect with centerline 32 so that the flap 34 that is formed there can seal around the conduit of conduits passing through the end grooves 16 or 20. In one embodiment, the shape of grooves 16 or 20 can be a keyhole shape shown in FIG. 10. The groove 16 is shown having a narrow portion 51 just wide enough to get a single conduit 24 through with some resistance and a broad portion 52 that can be sized to accept one or more conduits 24 snugly without materially spreading the narrow portion 50 apart after all the conduits are inserted. In FIG. 10 the long axis of the narrow portion 51 is aligned with the axis 32 but this is not required as shown in FIGS. 11-13. In FIG. 13 the narrow portion 51 is skewed with respect to axis 32 so as to create a flap 54 to press the narrow portion 51 closed when swelling occurs. Also shown in FIG. 11 is a coil or other form of slack 56 in the conduit 24 to account for differential expansion. While shown at both ends of a sealing element 12 the slack can be at just one end or it can be at opposed ends in different configurations.

Those skilled in the art can see that as opposed to the Swellpacker® design that simply runs a longitudinal groove in the sealing element and puts an uncovered control line into it, the various embodiments of the present invention enhance the sealing at a conduit 24 as well as the interface between the conduit covered in a sealing assembly 22 with its surrounding groove 18. Furthermore, by using smaller end grooves 16 and 20 with the option to orient those grooves askew from the centerline 32 enhancement of the seal at opposed ends of groove 18 are also realized. The positioning of a longitudinal cut in the assembly 22 in groove 18 further reduces leak path possibilities. Sizing the assembly 22 to swell within the confines of groove 18 and to not extend beyond the outer surface 14 of the swollen element 12 also allows full outer surface contact to the surrounding tubular and the further elimination of potential leak paths.

The above description is illustrative of the preferred embodiment and many modifications may be made by those skilled in the art without departing from the invention whose scope is to be determined from the literal and equivalent scope of the claims below:

We claim:

1. A swelling element packer for downhole use, comprising:

a mandrel;

a swelling sealing element on said mandrel having at least one groove extending into the swelling sealing element from an outer surface thereof;

at least one conduit extending beyond opposed ends of said groove in said swelling sealing element and covered at least in part between said opposed ends of said groove in said swelling sealing element by a sealing assembly;

at least a portion of said sealing assembly swells;

at least a portion of said sealing assembly disposed a furthest distance from said mandrel is covered by said swelling sealing element;

said sealing assembly is split over the length of said sealing assembly along a plane that does or does not intersect the centerline of said sealing assembly.

2. The packer of claim 1, wherein:

said sealing assembly swells.

3. The packer of claim 1, wherein:

said sealing assembly is forced into said groove in an interference fit before any swelling of said sealing assembly and said swelling sealing element.

4. A swelling element packer for downhole use, comprising:

a mandrel;

a swelling sealing element on said mandrel having at least one groove extending into the swelling sealing element from an outer surface thereof;

at least one conduit extending beyond opposed ends of said groove in said swelling sealing element and covered at least in part between said opposed ends of said groove in said swelling sealing element by a sealing assembly;

at least a portion of said sealing assembly disposed a furthest distance from said mandrel is covered by said swelling sealing element;

the swelling material of said swelling sealing element and at least a portion of said sealing assembly are identical;

said sealing assembly is split over the length of said sealing assembly along a plane that does or does not intersect the centerline of said sealing assembly.

* * * * *